US006375480B1

(12) United States Patent
Chen et al.

(10) Patent No.: US 6,375,480 B1
(45) Date of Patent: Apr. 23, 2002

(54) MODULAR JACK CONNECTOR HAVING A DUSTPROOF COVER

(75) Inventors: Qiang Chen; Guang Xing Shi; Sui Ya Wang, all of Kun-Shan (CN)

(73) Assignee: Hon Hai Precision Ind. OC., Ltd., Taipei Hsien (TW)

( * ) Notice: Subject to any disclaimer, the term of this patent is extended or adjusted under 35 U.S.C. 154(b) by 0 days.

(21) Appl. No.: 09/796,000

(22) Filed: Feb. 27, 2001

(30) Foreign Application Priority Data

Nov. 15, 2000 (TW) ..... 89219741 U

(51) Int. Cl.[7] ..... H01R 13/44
(52) U.S. Cl. ..... 439/142
(58) Field of Search ..... 439/142, 136, 439/135, 607–610, 138

(56) References Cited

U.S. PATENT DOCUMENTS 5,571,023 A * 11/1996 Anthony ..... 439/142
5,964,600 A * 10/1999 Miles et al. ..... 439/138
6,155,882 A * 12/2000 Wu ..... 439/142

* cited by examiner

*Primary Examiner*—Gary Paumen
(74) *Attorney, Agent, or Firm*—Wei Te Chung

(57) ABSTRACT

A modular jack connector (100) includes a housing (1) defining a cavity (15) in a front wall (14) thereof, a plurality of terminals (2) received in the cavity, a dustproof cover (3), and a shield (4). A pair of slots (142) is defined in the front wall and a pair of block portions (122) is formed on a top wall (11) of the housing. The dustproof cover comprises a main body (32) defining a channel (34) in its upper edge, a resilient fastener (36) extending from the main body (32), and a pair of pivots (38). The pivots are received in the slots and are retained in place by a front face (42) of the shield. An abutting portion (364) of the resilient fastener abuts the block portions in a closed position. A spring end portion (366) extending through the channel is depressed to open the closed dustproof cover.

1 Claim, 5 Drawing Sheets

MODULAR JACK CONNECTOR HAVING A DUSTPROOF COVER

BACKGROUND OF THE INVENTION

1. Field of the Invention

The present invention relates to a modular jack connector, and particularly to a modular jack connector having a dustproof cover assembled thereto.

2. Description of the Related Art

Referring to FIG. 5, Taiwan Patent No. 86207512 discloses a conventional modular jack connector 5 which comprises an insulative housing 50, a plurality of terminals 51 received in a cavity 501 of the housing 50, and a dustproof cover 53 assembled to a mouth of the cavity 501 for preventing dust from entering into the cavity 501 and degrading terminals 51 in the cavity 501. The dustproof cover 53 comprises a pair of pivots 531 at two opposite sides thereof and the housing 50 defines a pair of slots 502 at a front wall 503 thereof. The dustproof cover 53 is assembled to the housing 50 with the pivots 531 received in the slots 502. With this design, the pivot 531 of the dustproof cover 53 easily inserts into the slot 502, but also easily moves out of the slot 502 under vibration. Thus, the seal between the dustproof cover and the housing 50 is not reliable. In addition, when the dustproof cover 53 is to be detached from the housing 50, an additional tool (not shown) is needed to aid in separating the dustproof cover 53 from the housing 50. Finally, the dustproof cover 53 and the housing 50 are two separate parts; thus, the dustproof cover 53 can be lost when the dustproof cover 53 separates from the housing 50. Hence, an improved modular jack connector having a dustproof cover is required to overcome the disadvantages of the prior art. A copending application Ser. No. 09/746,247 filed Dec. 21, 2000 with the same assignee and one common inventor, discloses another approach using a linear insertion of the cover blocking the cavity of the modular jack.

BRIEF SUMMARY OF THE INVENTION

A first object of the present invention is to provide a modular jack connector having a dustproof cover which can be pivotally secured in the modular jack connector to prevent the dustproof cover from being lost from the modular jack connector.

A second object of the present invention is to provide a modular jack connector having a dustproof cover requiring no additional assembling tools to aid in separating the dustproof cover from the modular jack connector.

A third object of the present invention is to provide a modular jack connector having a dustproof cover occupying a small amount of space in the modular jack connector.

A fourth object of the present invention is to provide a modular jack connector having a dustproof cover which can be securely engaged with a housing of the modular jack connector.

A modular jack connector in accordance with the present invention comprises an insulative housing, a plurality of terminals, a dustproof cover, and a shield. The housing defines a cavity in a front wall thereof and the terminals are received in the cavity. A pair of slots is defined in the front wall and a pair of block portions is formed on a top wall of the housing. The dustproof cover comprises a main body, a channel defined in an upper portion of the main body, a resilient fastener extending from a back face of the main body below the channel and partly extending through the channel, and a pair of pivots extending from opposite sides thereof. The resilient fastener comprises an abutting portion extending upwardly and a spring end portion connecting with the abutting portion and partly extending through the channel. The shield comprises a front face with a mounting mouth defined therein which is wider than the main body of the dustproof cover. The dustproof cover is firstly mounted to the front wall of the housing with the pivots received into the slots. The shield encloses the housing with the pivots of the dustproof cover blocked by the front face of the shield from moving out of the slots. When the dustproof cover is closed against the housing, the abutting portion of the resilient fastener extends into the cavity of the housing and abuts against the block portions of the top wall of the housing. To open the dustproof cover, the spring end portion is pushed downwardly so that the abutting portion moves downwardly and disengages from the block portions of the housing, whereby the dustproof cover swings to an open position.

Other objects, advantages and novel features of the invention will become more apparent from the following detailed description of the present embodiment when taken in conjunction with the accompanying drawings.

DETAILED DESCRIPTION OF THE INVENTION

Figure 1:
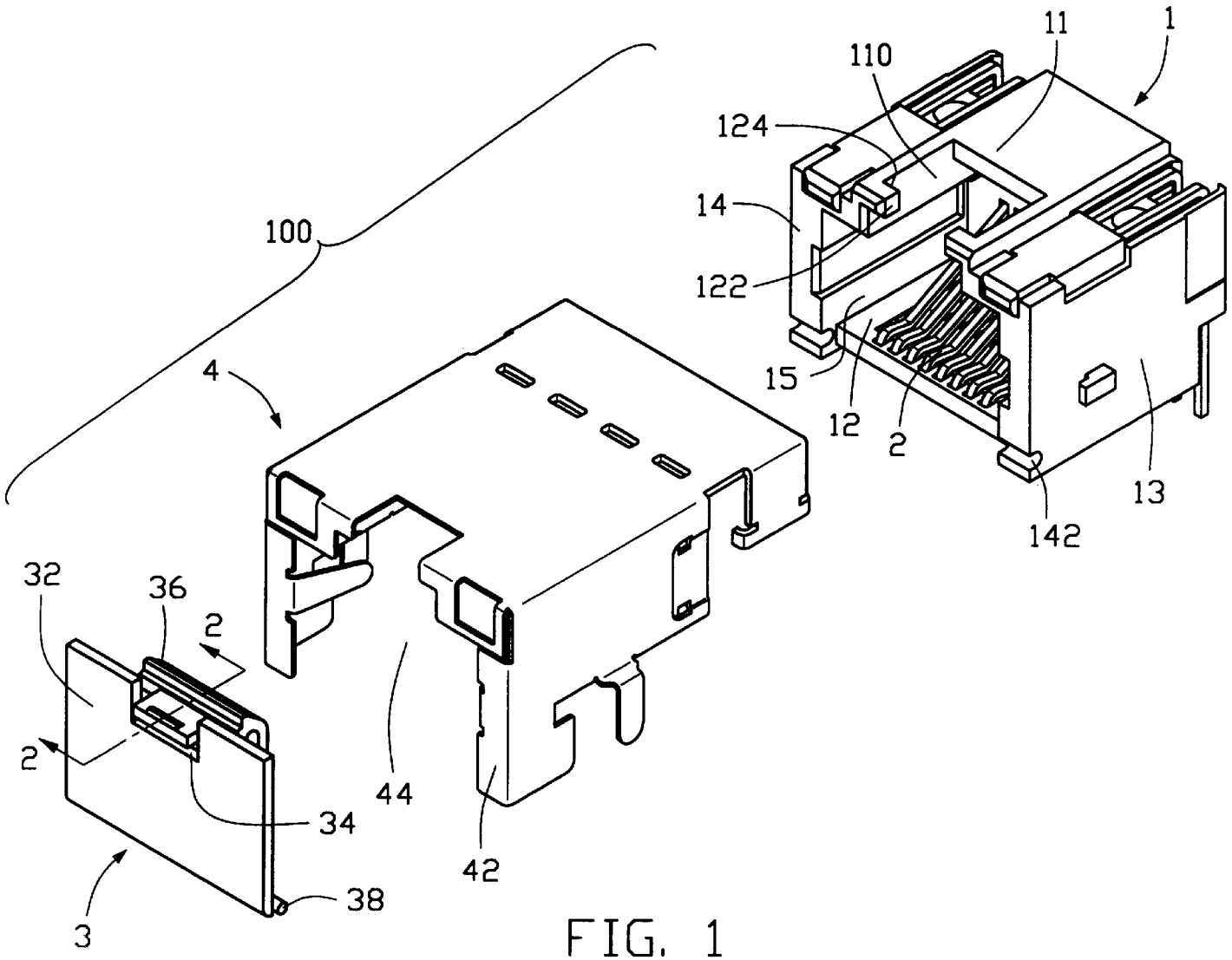
FIG. 1 is an exploded view of a modular jack connector in accordance with the present invention.

Referring to FIG. 1, a modular jack connector 100 in accordance with the present invention comprises an insulative housing 1, a plurality of terminals 2, a dustproof cover 3, and a conductive shield 4.

The housing 1 comprises a top wall 11, a bottom wall 12, a pair of side walls 13, and a front wall 14. The housing 1 further defines a cavity 15 in the front wall 14 thereof and the terminals 2 are received in the cavity 15. A pair of slots 142 is defined in the front wall 14 adjacent to the bottom wall 12. The top wall 11 of the housing 1 defines an opening 110 and a pair of block portions 122 beside the opening 110 and adjacent to the front wall 14. Each block portion 122 has an inner face 124 facing toward the opening 110 of the top wall 11.

Figure 2:
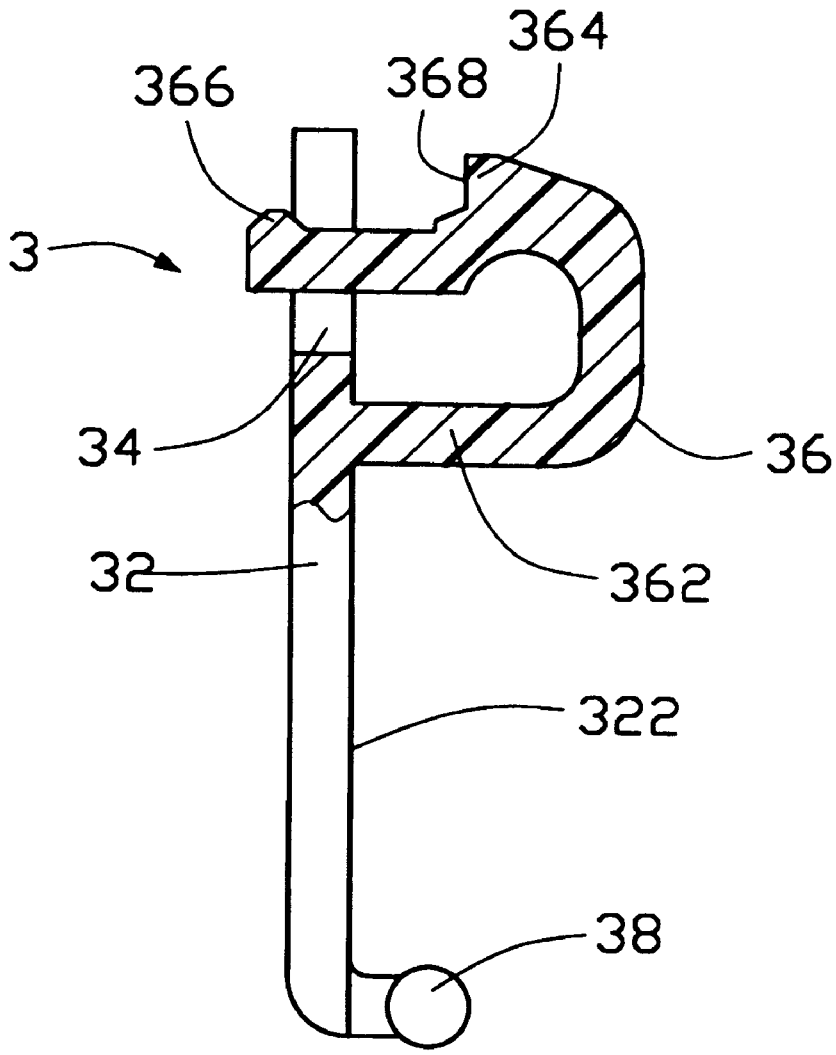
FIG. 2 is a partly cross sectional view of a dustproof cover of the modular jack connector of FIG. 1.

Referring to FIGS. 1 and 2, the dustproof cover 3 comprises a main body 32, a channel 34 defined in an upper portion of the main body 32, a resilient fastener 36 extending from a back face 322 of the main body 32 below the channel 34, and a pair of pivots 38 extending from opposite sides thereof adjacent to a bottom (not labeled) of the main body 32. The resilient fastener 36 comprises an arcuate beam 362 connected with the main body 32, an abutting portion 364 extending upwardly and forwardly from the arcuate beam 362, and a spring end portion 366 connecting with the abutting portion 364 and partly extending through the channel 34. The abutting portion 364 has an abutting face 368 for engaging with the inner face 124 of the block portion 122.

The shield 4 comprises a front face 42 with a mounting mouth 44 defined in the front face 42. The mounting mouth 44 is wider than the main body 32 of the dustproof cover 3.

Figure 3:
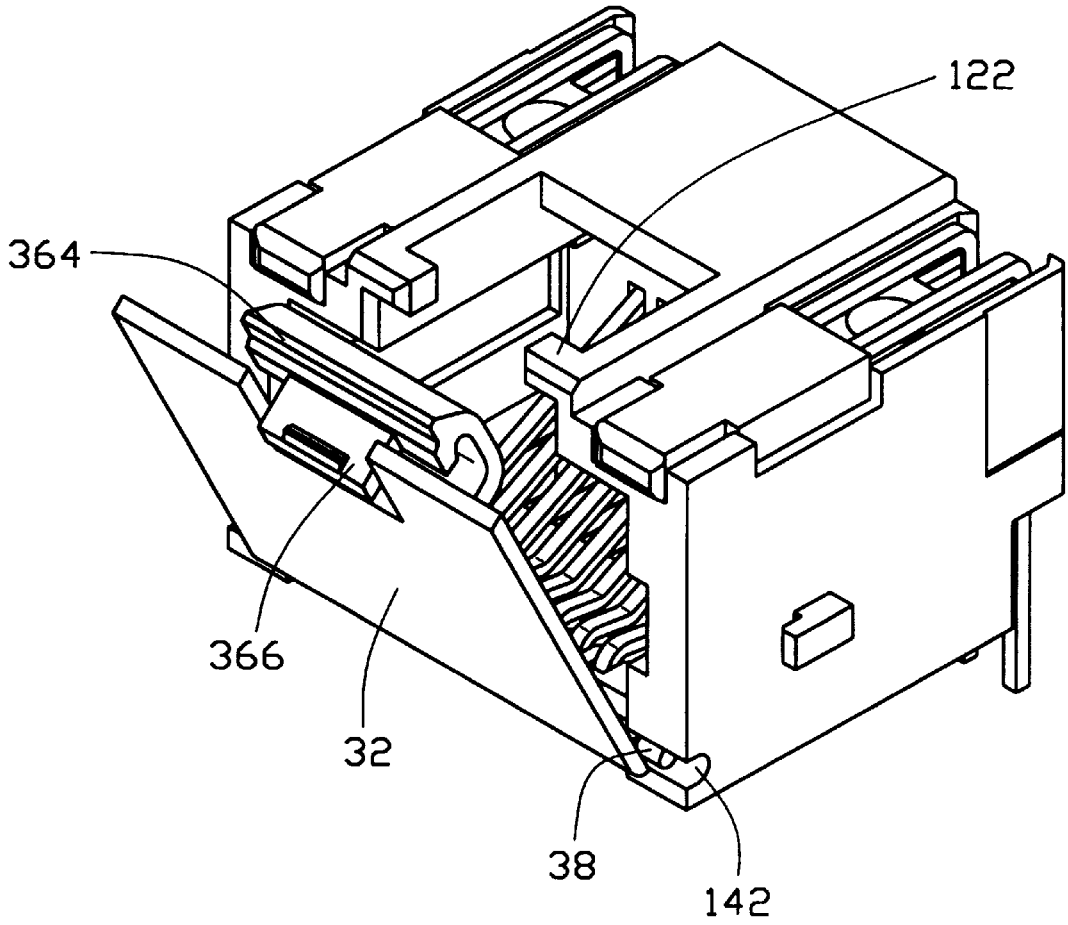
FIG. 3 is a partly assembled view of the modular jack connector of the present invention showing the dustproof cover assembled to a housing.
Figure 4:
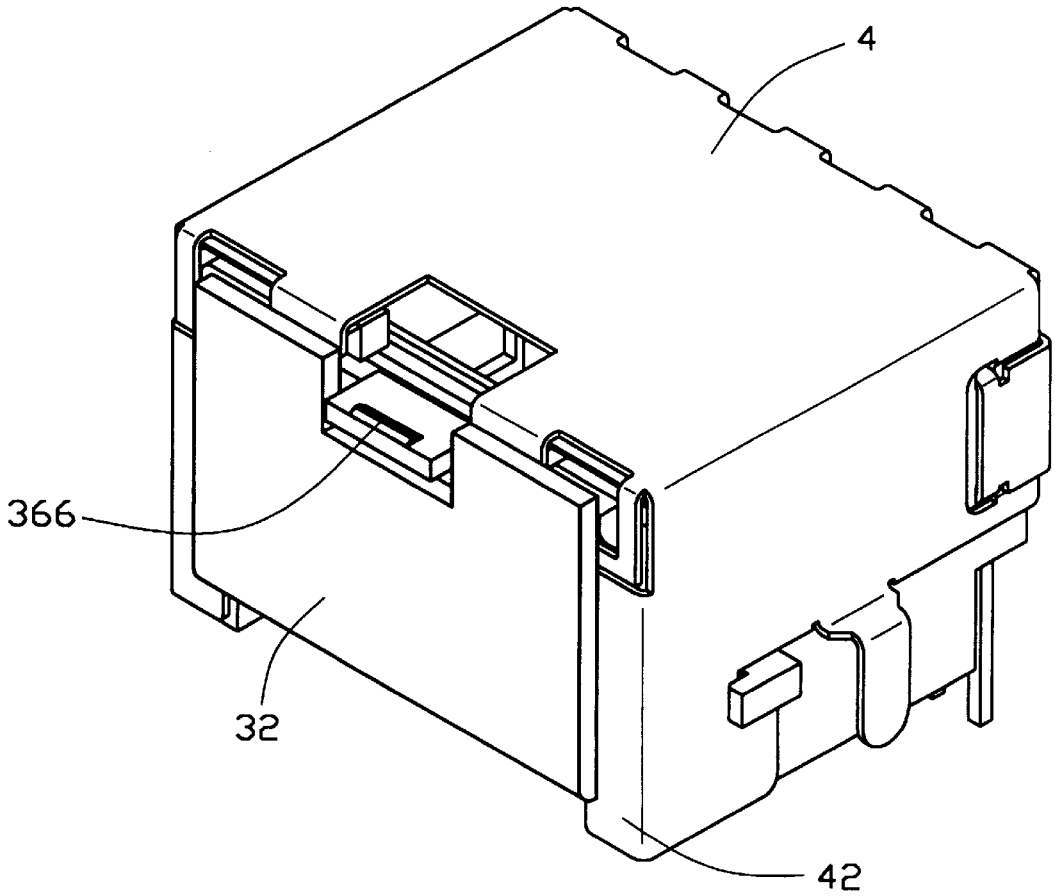
FIG. 4 is an assembled view of the modular jack connector.
Figure 5:
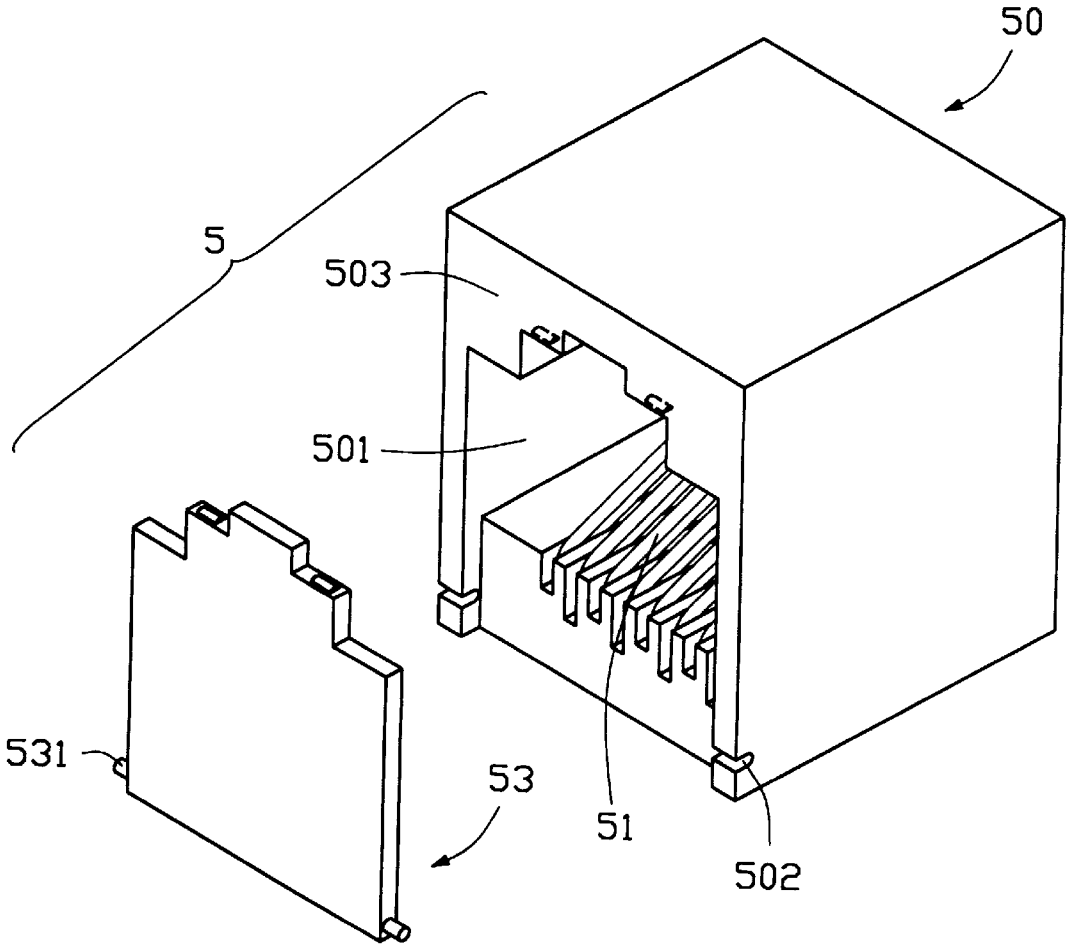
FIG. 5 (PRIOR ART)
FIG. 5 is a perspective view of a conventional modular jack connector.

Referring to FIGS. 3 and 4, in assembly, the dustproof cover 3 is firstly mounted to the front wall 14 of the housing 1 with the pivots 38 of the dustproof cover 3 received into the slots 142. The shield 4 secondly encloses the housing 1 with the pivots 38 of the dustproof cover 3 prevented by the front face 42 of the shield 4 from moving out the slots 142. When the dustproof cover 3 is closed against the housing 1, the resilient fastener 36 of the dustproof cover 3 enters into the cavity 15 of the housing 1 and the abutting face 368 of the abutting portion 364 abuts against the inner face 124 of the block portions 122 of the housing 1 whereby the dustproof cover 3 covers an opening of the cavity 15 in the front wall 14 of the housing 1. When the dustproof cover 3 is to be opened from the housing 1, an external force is exerted against the spring end portion 366 so that the spring end portion 366 is pushed down, the abutting portion 364 moves downward and disengages from the block portions 122 of the housing 1 whereby the dustproof cover 3 swings downward from the front wall 14 of the housing 1. Since the spring end portion 366 extends through the channel 34 from the back face 322 of the main body 32, no additional tools are required to open the cover 3; a user can manually depress the spring end portion 366.

When the modular jack connector 100 is not mated with a mating plug connector, the dustproof cover 3 can be closed against the front wall 14 of the housing 1 to prevent dust from entering into the cavity 15 of the housing 1. When the modular jack connector 100 is to be mated with a mating plug connector, the dustproof cover 3 is opened, allowing the mating plug connector to enter into the cavity 15.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack connector comprising:

a housing defining a cavity in a front wall thereof, a pair of slots defined in the front wall, and at least a block portion formed on a top wall thereof;

a plurality of terminals received in the cavity of the housing;

a dustproof cover comprising a main body, a channel defined in an upper portion of the main body, a resilient fastener extending from a back face of the main body, and a pair of pivots extending from opposite sides of the main body and received in the slots of the housing, the resilient fastener comprising an abutting portion extending upwardly and a spring end portion connecting with the abutting portion and partly extending through the channel; and a metal shield enclosing the housing, the shield comprising a front face with a mounting mouth defined in the front face, the pivots blocked by the front face of the shield from moving out of the slots;

wherein in the closed position, the abutting portion of the resilient fastener abuts against the block portion of the housing, thereby securing the dustproof cover against the front wall of the housing, and to open the cover, the spring end portion is pushed down by an external force and the abutting portion disengages from the block portion of the housing, whereby the dustproof cover swings downwardly from the front wall of the housing;

wherein the resilient fastener further comprises an arcuate beam extending from the back face of the main body and connecting to the abutting portion;

wherein the top wall of the housing further defines an opening adjacent to the block portion of the top wall;

wherein the mounting mouth of the shield is wider than the main body of the dustproof cover.

* * * * *